United States Patent [19]

Grantham

[11] 4,306,495

[45] Dec. 22, 1981

[54] LAUNDRY EXTRACTOR SYSTEM USING WRINGER ROLLS

[76] Inventor: Frederick W. Grantham, 12055 Goshen Ave., Los Angeles, Calif. 90049

[21] Appl. No.: 236,777

[22] Filed: Feb. 23, 1981

[51] Int. Cl.[3] ..... D06F 45/28

[52] U.S. Cl. ..... 100/37; 68/22 R; 68/245; 68/258; 68/268

[58] Field of Search ..... 68/19.1, 22 R, 210, 68/241, 245, 249, 256, 258, 267, 268; 100/35, 37; 34/216, 217

[56] References Cited

FOREIGN PATENT DOCUMENTS 596679 3/1978 U.S.S.R. ..... 68/22 R

*Primary Examiner*—Philip R. Coe

*Attorney, Agent, or Firm*—Henry M. Bissell

[57] ABSTRACT

An extractor system for commercial laundries includes a wringer roll extractor coupled via a feed conveyor to a shake-out tumbler into which batches of laundry are placed. The laundry is wet and compacted, having been transported from the washers. The wringer roll extractor compresses the laundry pieces with a force of 37,000 pounds between wringer rolls approximately 36 inches in diameter rotating at approximately 3.5 rpm. Under the pressure and time duration developed by this extractor, the laundry pieces give up water to a retention level of approximately 60%. A photocell is mounted on the feed conveyor to monitor the rate at which laundry pieces are fed to the extractor, operating through a speed control mechanism to limit the speed of the shake-out tumbler. A second photocell, also mounted on the feed conveyor, serves to monitor the flow of laundry items to detect the presence of larger clumps which have not been broken up by the shake-out tumbler. A signal from this photocell serves to turn off the motor driving the feed conveyor and to sound an alarm to alert the operator.

21 Claims, 5 Drawing Figures

LAUNDRY EXTRACTOR SYSTEM USING WRINGER ROLLS

BACKGROUND OF THE INVENTION

1. Field of the Invention

This invention relates to commercial laundry equipment and, more particularly, to apparatus for extracting water from washed laundry items in preparation for their being placed in a dryer.

2. Description of the Prior Art

Laundry operations typically include some arrangement for removing a substantial proportion of the water from the items being washed, following the wash cycle. This is generally accomplished in the home laundry by rotating the washing machine tub and agitator at high speed in a so-called "spin dry" cycle. Washing machines for home laundry use typically include a spin dry cycle after both the wash and rinse cycles to remove a substantial proportion of the water prior to the next step. When the clothes are removed from the washer, they are still damp and must be dried, either by hanging on a line or placing them in a tumbler dryer.

Essentially the same operations are performed in a commercial laundry, except that a separate extractor device is employed because of the volume of laundry involved. Laundry items are washed and rinsed in washers, after which they are usually placed in bags or slings suspended from overhead tracks for transporting to the extractor, followed by placing the damp laundry in carts or by using other means such as slings for transfer to a gas dryer. Some commercial laundries are equipped for continuous operation; however, the vast majority of laundries are equipped for batch operation in which a batch of laundry items (in approximately 200 lb. dry weight increments) is processed by the washer, then transported to an extractor and finally to a dryer. The present invention is particularly directed to batch-type laundry operations.

Probably the first use of mechanical extractors involved a pair of wringer rolls, hand-cranked through a gear mechanism. These were supplanted by motor-driven wringer-roll extractors which became the common extractor means in home washing machines until after World War II. In the commercial laundry field, however, other approaches to developing effective water extracting apparatus were adopted. In the 1930's, a hay baling press was adapted to squeeze water out of wet laundry. This then developed into a hydraulic ram extractor operated at pressures in excess of 2000 psi which pressed the laundry into "cakes". These cakes were frequently so tightly compacted that it was difficult to pull them apart with hand labor.

Centrifugal extractors have been used, operating on the same principle as the spin dry cycle in home washing machines. These extractors are slow, requiring substantial time for the water from the items nearest the center to pass through the outer items before being removed from the batch. Moreover, centrifugal extractors frequently develop imbalance in the load if the items are not properly placed within the extractor, thus shutting down the machine or, on occasion, developing damage from the unbalanced load.

Another type of extractor in the prior art uses a rubber bag within a solid cylindrical housing. The batch of wet laundry is placed in the rubber bag and water pressure, pumped to 400 psi, is developed in the space between the rubber bag and the housing, squeezing the laundry inside the bag to extract the water. Apparatus operating on this principle has many maintenance problems: pumps and seals fail, rubber bags burst, etc.

I have developed an extractor for handling batches of wet laundry items which incorporates the simple, reliable, wringer roll principle in a system for automatically breaking up the batches and feeding the laundry items to the wringer roll extractor in acceptable form.

SUMMARY OF THE INVENTION

In brief, arrangements in accordance with the present invention incorporate a powerful, heavy duty, wringer roll extractor coupled to a feed conveyor which receives laundry items at a relatively steady rate, adapted to the optimum operation of the extractor, from a breakup machine. The breakup machine is in the form of a shake-out tumbler which is adapted to receive compacted batches of wet laundry and break them up into individual pieces, distributing them across the feed conveyor in a form acceptable to the wringer roll extractor. In one preferred embodiment the shake-out tumbler is driven by a variable speed motor control system coupled to be responsive to signals from a first photocell mounted on the feed conveyor. The first photocell permits the shake-out tumbler to be operated at maximum speed until a certain level of laundry items on the feed conveyor is reached. This level is set to correspond to the optimum operation of the wringer-roll extractor which, in a preferred embodiment, has a pair of 30-inch diameter metal rolls or drums, each coated with a 3-inch thickness of neoprene rubber and pressed together with a force of 37,000 pounds for a pressure in the compression area of 310 pounds per square inch. In order to extract the water most effectively, the laundry items must be maintained under pressure for a certain minimum of time. It has been found that this requirement is satisfied by driving the rolls of this extractor at approximately 3.5 rpm.

A second photocell is also mounted on the feed conveyor, preferably at a level above the level of the first photocell, to detect the presence of clumps or bunches of laundry items which have not been effectively broken up by the shake-out tumbler. The second photocell provides a signal to a switch and alarm device which turns off the motor driving the feed conveyor and sounds an alarm so that an operator may remove, break up or redistribute the laundry items before restarting the conveyor. Where the second photocell is mounted downstream of the feed conveyor from the first photocell, the first photocell will have been triggered by the clump which interrupts the beam of the second photocell, thus also slowing the shake-out tumbler so that it operates more effectively in breaking up the batches of wet laundry. When the feed conveyor is restarted by the operator, the absence of any signals from the first photocell permit the speed control system to gradually bring the shake-out tumbler up to full speed again.

BRIEF DESCRIPTION OF THE DRAWING

A better understanding of the present invention may be had from a consideration of the following detailed description, taken in conjunction with the accompanying drawing in which.

DESCRIPTION OF THE PREFERRED EMBODIMENT

Figure 1:
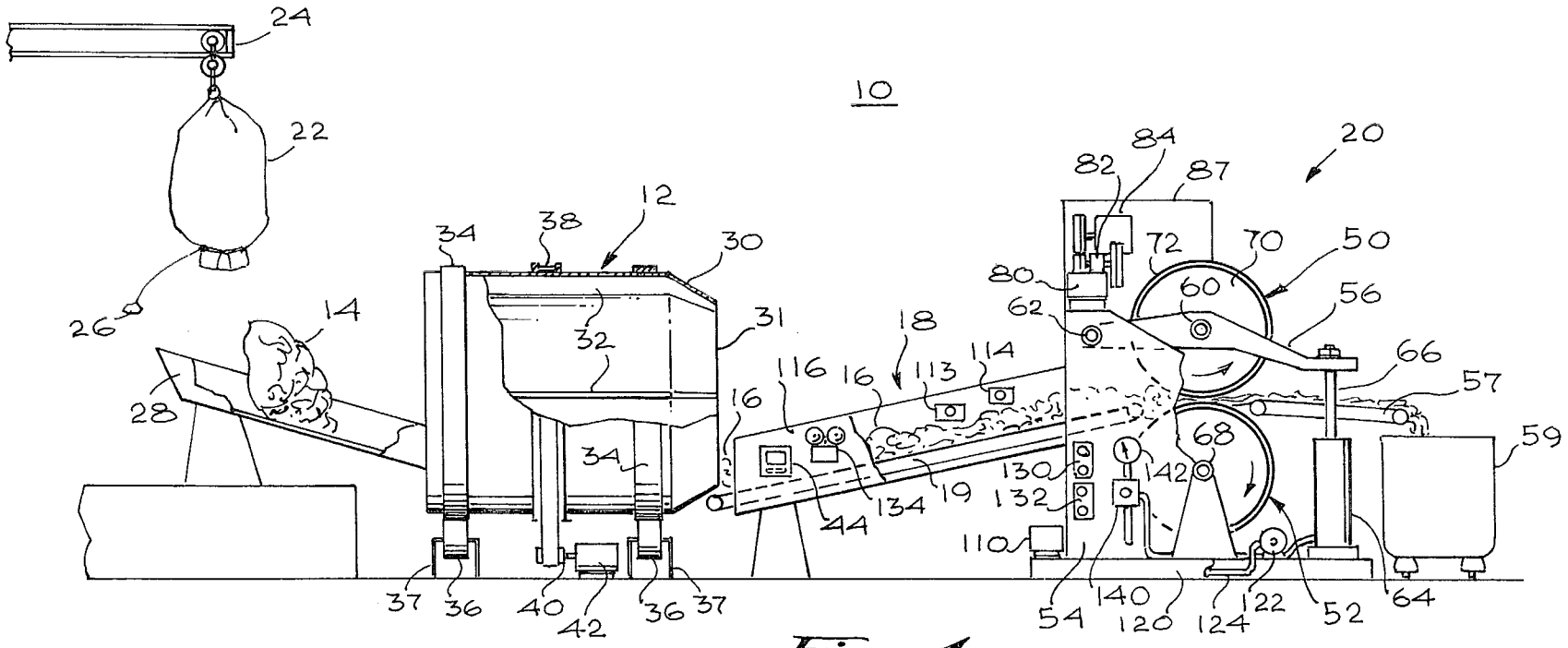
FIG. 1 is a diagram, partially broken away, showing the various components of an extraction system in accordance with the present invention.

As particularly illustrated in FIG. 1, a water extraction system 10 is shown having a shake-out tumbler 12 positioned to receive compacted batches of wet laundry 14 and to provide a stream of individual laundry pieces 16 to a feed conveyor 18 for transport to an extractor machine 20. The batches of laundry 14 are transported to the system 10 in bags or slings 22 suspended from an overhead rail system 24, which is common in commercial laundries of any substantial size. Some laundries operating on the batch principle have a capacity of processing as much as a million pounds of laundry per five-day week. A carrier bag such as 22 is used to bring the batch of laundry 14 to the vicinity of the extraction system 20, where the laundry batch is released from the bag 22 by an operator pulling the string 26 and dropping the laundry onto a slide or conveyor 28.

The shake-out tumbler 12 includes a hollow drum 30 having openings at both ends and a plurality of blades 32 extending radially inwardly from the drum walls, much in the fashion of a dryer tumbler. The drum 30 is rotatable about its central axis by means of circumferential bands or rails 34 riding on rollers 36 supported by clocks 37 and is driven by a circumferential belt 38 which extends about the drive pulley 40 of an adjacent motor 42. The motor 42 is operated by a variable speed drive system 44 of conventional design, known in the art.

Figure 2:
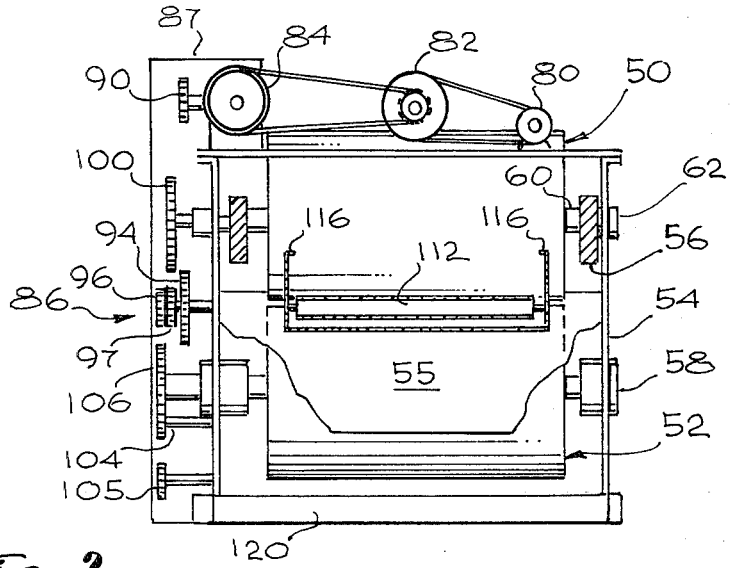
FIG. 2 is an elevational view of the extractor machine of FIG. 1, viewed from the input end.
Figure 3:
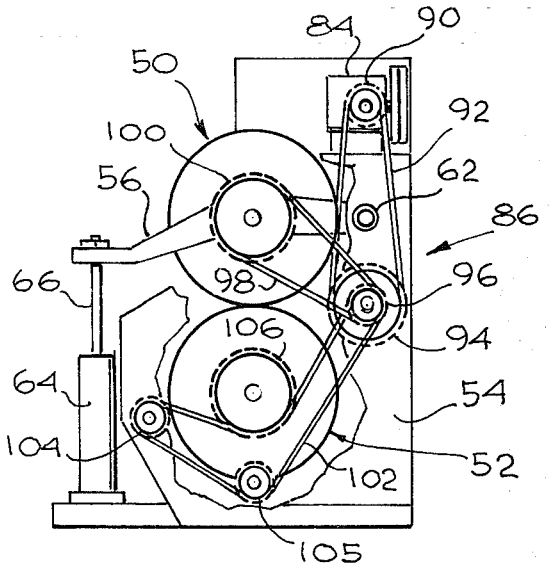
FIG. 3 is an elevational view, in schematic form, of the left-hand side of the extractor as viewed in FIG. 2.

The extractor 20, as illustrated in FIGS. 1–3, includes a pair of large wringer rolls 50, 52 suspended on a substantial frame structure including fixed frame side plates 54, a front plate 55 and levers 56. The lower wringer roll 52 is suspended for rotation about a central axis in hearings 58 mounted in the side plates 54. The upper wringer roll 50 is suspended for rotation about a central axis in bearings 60 mounted in levers 56. The levers 56 pivot about bearings 62 in the side plates 54 under the pull-down forces of pressure cylinders 64 and pull rods 66. The bearings, levers and cylinders are the same on both sides. Each of the wringer rolls 50, 52 comprises a hollow metal drum 70 coated with a layer 72 of resilient material, such as neoprene rubber.

In the preferred embodiment of my invention, the drums 70 are 30 inches in diameter, 30 inches long, and fabricated of mild steel. They are coated with a 3-inch layer of neoprene rubber, and driven to rotate at a speed of 3.5 rpm. The speed is reduced from a 2 HP motor 80, operating at 1800 rpm, through a first pulley reduction stage 82, a worm gear stage 84, and finally by a sprocket drive system 86 (see FIGS. 2 and 3) within a guard housing 87. This system 86 includes a first drive sprocket 90 coupled to the output of the worm gear reduction stage 84 and connected by a sprocket chain 92 to a second drive sprocket 94. A pair of smaller sprockets 96, 97 are mounted on the same shaft with the drive shaft 94. Sprocket 97 is coupled via chain 98 to a sprocket 100 mounted on the shaft of the upper roll 50. Sprocket 96 is coupled via chain 102 in a reversing arrangement including sprockets 104, 105 to a sprocket 106 mounted on the shaft of the lower wringer roll 52. By means of this arrangement, both of the wringer rolls 50, 52 are positively driven from the drive motor 80.

The feed conveyor 18 includes a belt 19 powered by a drive motor 110 (FIG. 1) coupled to the drive roll 112 by a sprocket and chain arrangement (not shown). First and second photocells 112, 114 are mounted on one of the conveyor side walls 116 opposite a light beam source (not shown).

A catch basin 120 is positioned underneath the rolls 50, 52 to catch the water extracted from the wet laundry. The extracted water runs down the roll 52 and drops into the catch basin 120, from whence it is pumped by a pump 122 through a waste line 124 to a drain. The compressed laundry items are fed from the rolls 50, 52 via an exit conveyor 57 to a cart 59.

The electrical control system (shown in FIG. 1) incorporates a master control switch 130, a sub-control switch 132, the variable speed control 44 and a switch/alarm 134. The speed control unit 44 includes a switch for turning power on or off to the tumbler drive motor 42. The sub-control switch 132 controls power to the conveyor motor 110 and the wringer roll motor 80. The master switch 130 controls power to the overall system.

Compressed air is provided via a regulator 140 to the pressure cylinders 64. An associated gauge 142 indicates the level of air pressure.

Figure 4:
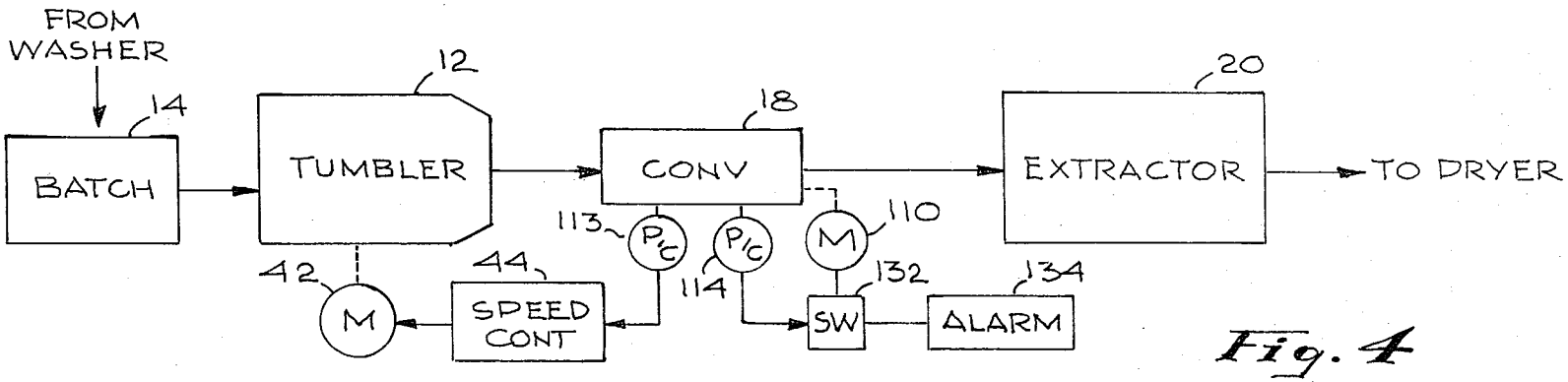
FIG. 4 is a block diagram illustrating the operation of the system of the invention.

As indicated in the block diagram of FIG. 4, a batch 14 of compacted wet laundry is received from the washer and dumped into the tumbler 12. The drum 30, rotated by the motor 42, operates to break up the batch 14 into more or less individual laundry items which are placed on the conveyor belt 19 for delivery to the extractor 20. The maximum speed of the tumbler 12 is selected to be compatible with the speed of operation of the extractor 20. The speed control 44 is effective to control the motor 42 to drive the tumbler 12 at this maximum speed, except when the level of laundry items on the conveyor belt 19 exceeds a preset threshold level. At such time, the first photocell 112 applies signals to the speed control unit 44 which are effective to reduce the speed of the motor 42, thereby tending to reduce the rate at which the tumbler 12 provides laundry items to the conveyor 18. Should some clump or bunch of laundry items get through the tumbler 12 and onto the conveyor 18, it will be detected by the first photocell 112, thereby causing the speed control 44 to reduce the speed of the motor 42 and tumbler 12 momentarily. However, it will also trip the second photocell 114 which applies a signal to the sub-control switch 132, thereby interrupting power to the conveyor drive motor 110 and stopping the conveyor belt 19. At the same time, the switch 132 energizes an alarm 134 to alert an operator. After the operator removes or breaks up the clump of compacted laundry at the conveyor belt 19, the conveyor motor 110 is again energized and the system continues as before.

As an alternative to the variable speed drive system for the tumbler 12 as shown in FIGS. 1 and 4, the rate of supply of the laundry items to the conveyor 18 may be controlled by suspending the drum 30 on a pivotable frame capable of varying the angle of the axis of the drum 30. In this manner, the drum 30 may be tilted to raise or lower the outlet opening 31, thus decreasing or increasing the rate at which laundry items are delivered to the conveyor 18. Such an arrangement for controllably varying the tilt angle of a rotary drum tumbler is shown and described in my U.S. Pat. No. 4,015,930, entitled CONTINUOUS LAUNDRY DRYING APPARATUS, incorporated herein by reference. That patent discloses a flow through dryer having a tumbler with openings at both ends for receiving laundry items at one end and delivering the dried articles out the other. The rate at which the articles proceed through the rotating tumbler may be controlled by adjusting a pair of fluid pressurized jacks to vary the angle of the drum axis. An equivalent mechanism may be employed for the shake-out tumbler 12 of the present invention and is shown in FIG. 5.

Figure 5:
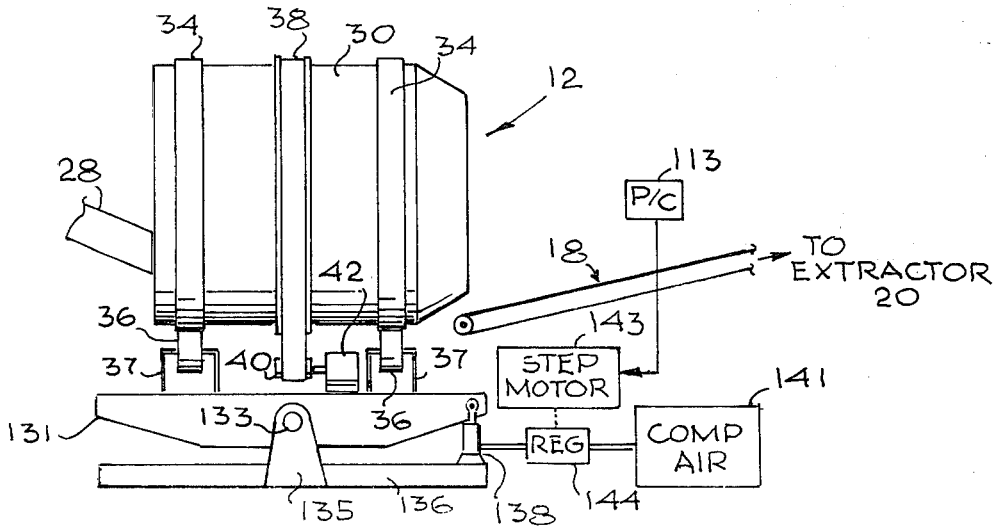
FIG. 5 is a side elevational view of the shake-out tumbler of FIG. 1, showing an alternative speed control system.

FIG. 5 is a schematic diagram illustrating an alternative speed control arrangement for the shake-out tumbler 12 of FIG. 2. In this arrangement, the rotational speed of the tumbler is not varied but the feed rate of laundry items to the conveyor 18 is controlled by selectively varying the tilt angle of the tumbler 12.

As shown in FIG. 5, the suspension and drive arrangement for the tumbler 12 is essentially as previously described in connection with FIG. 1. However, the entire assembly, including the roller supports 37 and motor 42, is mounted on a sub-frame 130 that is pivotably mounted for rotation about a transverse axis 132 in support members 134 extending from a base 136. By pivoting about the transverse axis 132, the central axis of the drum 12 can be varied above or below the horizontal. The degree of tilt of the tumbler 12 is controlled by pneumatic jacks 138 extending between the sub-frame 130 and the base 136. The jacks 138 receive compressed air from a source 140 via a regulator 142. The regulator 142 is capable of varying the pressure of the air delivered to the jacks 138 in known fashion under control of signals from the first photocell 112, as for example by means of a stepping motor 143 responsive to the photocell signals.

Thus, when signals are developed by the photocell 112, indicating that the level of laundry items on the conveyor 18 exceeds the level for optimum operation of the extractor 20, the stepping motor 143 drives the regulator 142 to increase the air pressure at the jacks 138, causing the sub-platform 130 to tilt and raise the outlet end of the drum 30. This reduces the rate of delivery of laundry items from the tumbler to the conveyor 18, thus lowering the level of the laundry items on the conveyor belt 19 to within desired operating limits. Conversely, in the absence of signals from the photocell 112, corresponding to a condition in which an increased feed rate of the laundry items is appropriate, the regulator 142 is controlled to reduce the air pressure at the jacks 138, thereby causing the platform 130 to be pivoted so as to lower the outlet end of the drum 30 and increase the feed rate of the laundry items.

There has thus been disclosed a water extraction system for use in commercial laundries or the like. The system utilizes a large, heavy duty, wringer roll extractor in conjunction with a shake-out tumbler for breaking up batches of wet laundry items. The shake-out tumbler is operated at a controlled rate to deliver separated laundry items to the extractor feed conveyor at a speed which is compatible with optimum extractor operation. The overall system is particularly adapted to batch operation, and is extremely effective, reliable and virtually maintenance-free. The extractor of the system of the invention removes water from wet laundry items to a retention level of approximately 60%, meaning that for every 100 pounds of dry laundry, the items processed by the extractor contain approximately 60 pounds of water. This is a fairly low retention level and corresponds to items which are only slightly damp (to the point where it is impossible for one to squeeze water from the items by manual manipulation). By virtue of the effectiveness of the system of the present invention, machine failures and down time of commercial laundry extractors are reduced, the requirement for operator labor is minimized, and overall efficiency of the laundry operation is improved.

Although there have been described above specific arrangements of a wringer roll extraction system in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. An extractor system for use in commercial laundries or the like comprising:

a continuous feed extractor positioned to receive individual damp laundry items and to compress water therefrom in continuous flow-through operation;

a feed conveyor positioned to receive a series of laundry items at an input end and to transport the laundry items to the vicinity of the extractor;

break-up means for receiving batches of wet laundry, breaking up the batches of laundry into a stream of individual items and supplying the stream of laundry items to the conveyor; and means for causing the break-up means to automatically vary the rate of delivery of the laundry items to the feed conveyor in accordance with predetermined control parameters.

2. The apparatus of claim 1 wherein the extractor is a wringer roll extractor and the break-up means comprises a shake out tumbler having a rotary drum for tumbling the laundry batches to break them up into individual items.

3. The apparatus of claim 2 wherein the extractor comprises a pair of large wringer rolls coated with a resilient material and mounted to rotate in opposite directions in surface contact with one another, a lever mechanism for drawing the wringer rolls together, and at least a pair of compression cylinders for varying the force applied to the lever mechanism in order to control the pressure between the rolls.

4. The apparatus of claim 3 further including means for positively driving both of said rolls from a drive motor to operate at a selected low rate of rotation effective to extract water from wet laundry items.

5. The apparatus of claim 2 further including means for monitoring the level of laundry items on the feed conveyor, and means for reducing the rate of feed from the tumbler when a predetermined level is detected.

6. The apparatus of claim 5 further including means for rotating the tumbler at a predetermined rate selected to correspond to an optimum rate of feed of laundry items to the extractor, and means for reducing the rate of rotation of the tumbler in response to signals from the monitoring means.

7. The apparatus of claim 5 wherein the monitoring means includes a first photocell positioned at a selected level above the feed conveyor and coupled to the variable speed drive of the tumbler to reduce the rotational speed of the tumbler in response to signals from the first photocell.

8. The apparatus of claim 5 or claim 7 further including a second photocell mounted at a predetermined level adjacent the conveyor for monitoring the laundry items on the conveyor and generating a signal effective to stop the conveyor upon detection of a clump of laundry large enough to interrupt the beam to the second photocell.

9. The apparatus of claim 8 further including means responsive to a signal from the second photocell to sound an alarm.

10. The apparatus of claim 2 wherein the shake-out tumbler comprises a rotatable drum having openings at opposite ends and a plurality of blades mounted to the interior walls of the drum at regularly spaced intervals and directed radially inward, the blades being effective to break up batches of wet laundry into individual laundry items.

11. The apparatus of claim 10 further including means for controlling the tumbler to selectively reduce the rate at which laundry items are delivered from the tumbler to the feed conveyer.

12. The apparatus of claim 11 wherein said last-mentioned means comprise means for varying the speed of rotation of the tumbler.

13. The apparatus of claim 11 wherein said last-mentioned means include means for selectively varying the angle of the axis of the tumbler drum relative to the horizontal.

14. The apparatus of claim 11 further including means for monitoring the laundry items on the conveyor and generating control signals for application to the tumbler controlling means to reduce the delivery rate accordingly.

15. The apparatus of claim 14 further including additional means for monitoring the laundry items on the conveyor to detect clumps of laundry, and means responsive to the additional monitoring means for stopping the conveyor and activating an alarm upon detection of a clump of laundry.

16. The method of automatically adapting a batch operated laundry system for use with a continuous feed extractor including the steps of:

receiving a compacted batch of wet laundry and processing it to break it up into a plurality of individual laundry items;

supplying the individual laundry items in a generally uniform stream to a conveyor;

operating the conveyor to direct the stream of laundry items at a steady rate to a continuously operating, feed-through extractor;

monitoring the stream of laundry items on the conveyor; and automatically varying the rate of delivery of the laundry items to the conveyor in accordance with signals derived from the monitoring step.

17. The method of claim 16 further including the step of squeezing water from the laundry items in the feed-through extractor.

18. The method of claim 16 further including the step of reducing the rate of delivery of the laundry items to the conveyor upon the detection of laundry items on the conveyor at a level exceeding a preselected optimum rate of delivery to the extractor.

19. The method of claim 18 further including the step of using a rotating tumbler to break up the batch of laundry and wherein the step of reducing the delivery rate includes reducing the speed of rotation of the tumbler.

20. The method of claim 18 further including the step of using a rotating tumbler to break up the batch of laundry and wherein the step of reducing the delivery rate includes varying the angle of the central axis of the tumbler.

21. The method of claim 16 wherein the monitoring step further includes the step of detecting the presence of a clump of laundry on the conveyor and thereupon stopping the conveyor and sounding an alarm in response to the detection of the clump of laundry.

* * * * *